US005685173A

United States Patent [19]

De L'Isle et al.

[11] Patent Number: 5,685,173

[45] Date of Patent: Nov. 11, 1997

[54] PROCESS AND PLANT FOR THE PRODUCTION OF A GAS UNDER PRESSURE BY CRYOGENIC DISTILLATION

[75] Inventors: Mike De L'Isle, Paris; Yves Koeberle, Le Plessis Robinson, both of France

[73] Assignee: L'Air Liquide, Societe Anonyme pour l'Etude et l'Exploitation des Procedes Georges Claude, Paris Cedex, France

[21] Appl. No.: 710,951

[22] Filed: Sep. 24, 1996

[30] Foreign Application Priority Data

Sep. 29, 1995 [FR] France ..... 95 11474

[51] Int. Cl.[6] ..... F25J 3/00

[52] U.S. Cl. ..... 62/646; 62/654; 62/940

[58] Field of Search ..... 62/654, 646, 940

[56] References Cited

U.S. PATENT DOCUMENTS

| | | | |
|---|---|---|---|
| 2,908,144 | 10/1959 | First et al. . | |
| 5,036,672 | 8/1991 | Rottmann | 62/654 |
| 5,152,149 | 10/1992 | Mostello et al. . | |
| 5,337,571 | 8/1994 | Ducrocq et al. | 62/654 |
| 5,566,556 | 10/1996 | Ekins et al. | 62/654 |

*Primary Examiner*—Ronald C. Capossela
*Attorney, Agent, or Firm*—Young & Thompson

[57] ABSTRACT

In a process for the production of gas under pressure by cryogenic distillation, the gas is produced by vaporizing (or pseudo-vaporizing) a liquid drawn off from a distillation column. In order to supply additional gas under pressure, a flow of a gas coming from an external source is at least partially liquefied, and the liquid thus formed is added to the liquid drawn off from the column before or after an optional pressurization step.

17 Claims, 1 Drawing Sheet

Figure 1:
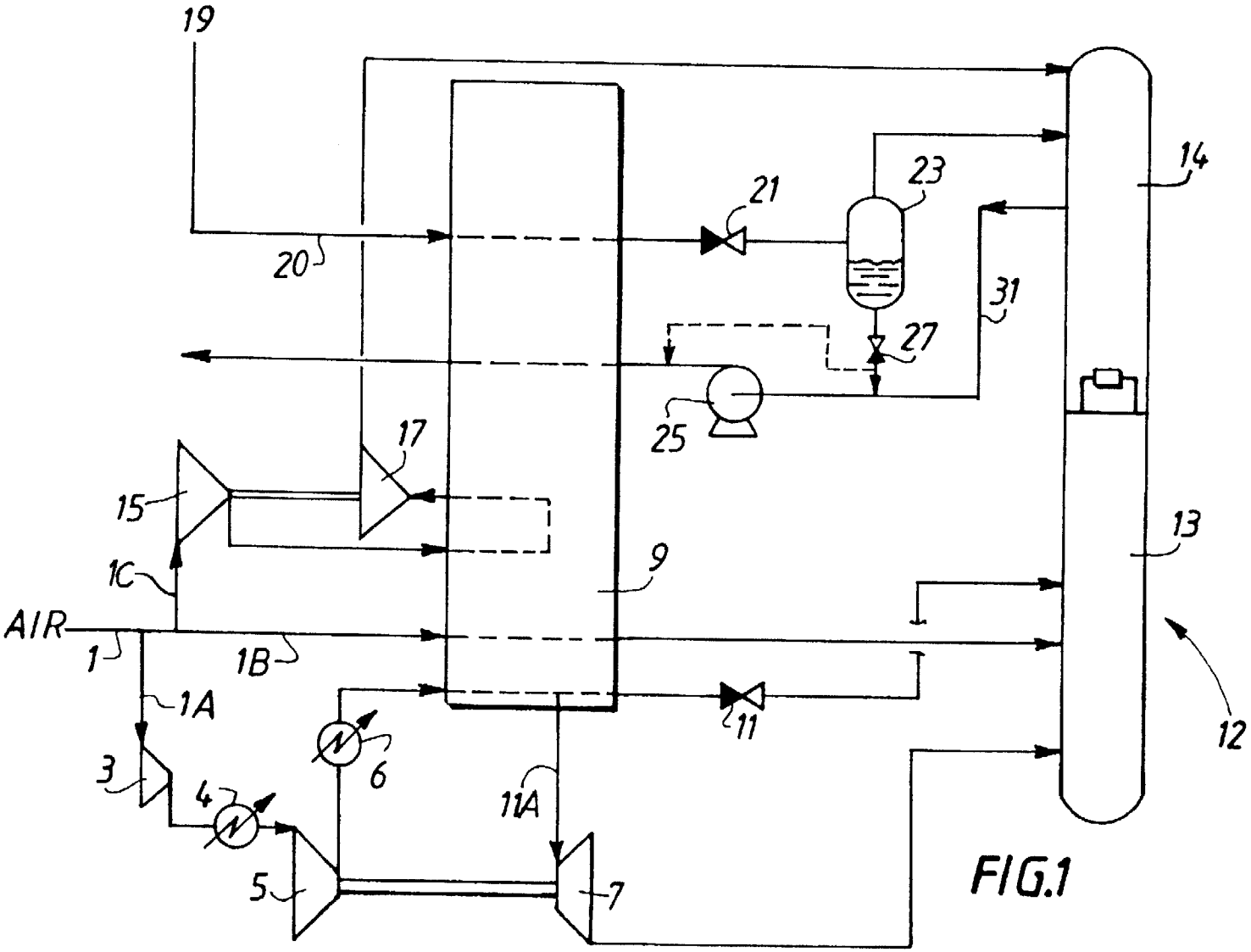

PROCESS AND PLANT FOR THE PRODUCTION OF A GAS UNDER PRESSURE BY CRYOGENIC DISTILLATION

The present invention relates to a process and to a plant for the production of gas under pressure by cryogenic distillation. In particular, it relates to a process in which gas under pressure is produced by vaporizing a liquid drawn off from a cryogenic distillation column.

Processes of this type are well-known in the art and have existed for several decades.

In the present document, the pressures referred to are absolute pressures. Furthermore, the terms "condensation" and "vaporization" are intended to mean either condensation or vaporization proper, or pseudo-condensation or pseudo-vaporization, depending on whether the pressures are sub-critical or supercritical.

The object of the invention is to make it possible to supply the maximum demand for gas under pressure with an apparatus designed to produce only a part of the liquid required for supplying the maximum gas demand.

According to the invention, a process is provided for the production of a gas under pressure in a cryogenic separation apparatus, comprising the steps of:

i) cooling a fluid to be separated in a heat exchanger and sending it to a distillation column of the apparatus for separation therein;

ii) drawing off a liquid flow from a column of the apparatus and heating it in the exchanger, characterized in that iii) at least one make-up liquid is added to the liquid flow drawn off in step ii);

iv) the mixture thus formed by the make-up liquid and the flow drawn off is heated by indirect heat exchange in an exchanger; and v) a gas under pressure is recovered at the outlet of the apparatus.

In this way, a gas coming from an external source is used to make up for the lack of liquid when the apparatus is operating at its maximum capacity.

The liquefied make-up gas may have the same composition as the liquid flow drawn off.

The liquid may be an atmospheric gas. For example, liquid nitrogen may be drawn off from the head of a single column or of a low-pressure or medium-pressure column of a double column. Liquid argon may be obtained at the head of an argon column. However, the invention also applies to the separation of other cryogenic fluids; the liquid to be vaporized could be methane, carbon monoxide or hydrogen, for example.

Before it is vaporized, the liquid may be pressurized either by hydrostatic pressure or using a pump.

If the make-up gas is already at the vaporization pressure of the liquid drawn off, after it has been liquefied, it may be added to the drawn-off liquid downstream of the pressurization means. Otherwise, the liquefied make-up gas is mixed with the liquid upstream of the pump, before being pressurized therein.

The liquefied make-up gas preferably constitutes 20% of the vaporized liquid flow, thus allowing the apparatus to be designed for a capacity which represents 80% of maximum demand.

According to the invention, a plant is also provided for the production of a gas flow under pressure by cryogenic distillation, comprising at least one distillation column, a heat exchanger, means for sending a fluid to be separated by distillation to a distillation column, means for drawing off a liquid from a distillation column, and means for sending the drawn-off liquid to the heat exchanger in order to heat the liquid, characterized in that it comprises means for adding a make-up liquid to the drawn-off liquid upstream of the exchanger and means for sending the mixture thus formed to the exchanger in order to vaporize it and form the gas under pressure.

An illustrative embodiment of the invention is shown in FIG. 1, which schematically represents a plant according to the invention.

An airflow 1 is compressed to $5.6\times10^5$ kPa in a compressor, before being divided into three fractions. The first fraction 1A is compressed to $62\times10^5$ kPa by the compressor 3, refrigerated at 4 and compressed to $76\times10^5$ kPa. After a second refrigeration step at 6, the fraction 1A is cooled in a main exchanger 9. A part of the partially cooled air 11A is drawn off at an intermediate temperature level from the exchanger 9 and pressure-relieved, to the pressure of a medium-pressure column 13 of a double column 12, in a turbine 7. The pressure-relieved air is then sent into this column 13. The remaining part of the flow 1A continues to be cooled in the exchanger 9, condenses and is pressure-relieved, to the pressure of the column 13, in the valve 11 before being sent into this column.

The fraction 1B passes through the exchanger 9 before being introduced at the bottom of the column 13.

The fraction 1C is compressed to $8.9\times10^5$ kPa by the compressor 15, partially cooled in the exchanger 9 and pressure-relieved, to the pressure of the low-pressure column 14, by the injection turbine 17. The pressure-relieved fraction 1C is sent to the column 14, optionally after a supercooling step. The injection turbine 17 drives the compressor 15.

The double column 12, comprising the low-pressure column 14 and the medium-pressure column 13, is designed to produce an average liquid flow which vaporizes in the exchanger 9 to form a gas under pressure. In the example, the liquid is oxygen drawn off at a pressure of about $1.5\times10^5$ kPa from the bottom of the column 14 via the conduit 31. The liquid is pressurized to $76\times10^5$ kPa by a pump 25, before being vaporized in the exchanger 9 to form oxygen under pressure.

Make-up oxygen gas comes from a network 19 at $30\times10^5$ kPa. The make-up gas from the conduit 20 cools in the exchanger 9, is pressure-relieved through the valve 21 and is separated into two phases in the separator 23. The gaseous part of the oxygen is sent at least in part to the low-pressure column 14. The liquid part is sent to the conduit 31 upstream or downstream of the pump 25 when the oxygen demand exceeds the maximum capacity of the double column 12, which represents 80% of the maximum demand. The liquid coming from the network is thus vaporized to form up to 20% of the maximum demand. This percentage is limited by the capacity for liquefying the oxygen from the network acceptable to the exchanger 9.

In this way, a down-sized apparatus can nevertheless be used to supply the entire demand for oxygen gas under pressure, with lower energy costs.

We claim:

1. Process for the production of a gas under pressure in a cryogenic separation apparatus, comprising the steps of:

i) cooling in a heat exchanger a fluid to be separated and sending it to a distillation column of the apparatus;

ii) drawing off a liquid flow from the column of the apparatus;

iii) adding at least one make-up liquid to the liquid flow drawn off in step ii);

iv) heating the mixture thus formed by the make-up liquid and the liquid flow drawn off by indirect heat exchange in the exchanger; and v) recovering a gas under pressure at an outlet of the apparatus.

2. The process according to claim 1, further comprising the steps of cooling a make-up gas from an external source (19) in the exchanger, and at least partially condensing the cooled make-up gas to form the make-up liquid.

3. The process according to claim 2, further comprising the step of cooling the make-up gas in the exchanger.

4. The process according to claim 1, in which the make-up liquid and the liquid flow drawn off have substantially the same composition.

5. The process according to claim 1, in which the liquid flow drawn off is a liquid enriched in one of oxygen, nitrogen, argon and methane.

6. The process according to claim 1, in which most of the gas under pressure comes from a low-pressure distillation portion of the column.

7. The process according to claim 6, in which at least 80% of the gas under pressure comes from the low-pressure column.

8. The process according to claim 1, in which the make-up liquid is added to the liquid flow drawn off adjacent a pressurization means.

9. The process according to claim 1, in which the mixture heated in step (iv) vaporizes.

10. The process according to claim 1, in which the only output of the process is the gas under pressure.

11. An improved plant for the production of a gas flow under pressure by cryogenic distillation, comprising at least one distillation column (13, 14), a heat exchanger (9), means (1A, 1B, 1C) for sending a fluid to be separated by distillation to the distillation column (13, 14), means (31) for drawing off a liquid from the distillation column (14), and means for sending the drawn-off liquid to the heat exchanger (9) in order to heat the drawn-off liquid, the improvement comprising:

means (27) for adding a make-up liquid to the drawn-off liquid upstream of the exchanger and means for sending the mixture thus formed to the exchanger (9) in order to form the gas under pressure.

12. The plant according to claim 11, further comprising means (20) for sending a make-up gas coming from an external source to the exchanger (9) in order to cool the make-up gas, the means (21, 23) for liquefying the at least partially cooled make-up gas in order to form the make-up liquid.

13. The plant according to claim 11, in which the drawn-off liquid is a liquid enriched in one of oxygen, nitrogen and argon.

14. The plant according to claim 11, in which the distillation column is a double air-distillation column and wherein the means for drawing off a liquid are connected to a low-pressure column of the double air-distillation column.

15. The plant according to claim 11, in which the means for sending the drawn-off liquid to the exchanger are connected to a pressurization means (25) upstream of the exchanger.

16. The plant according to claim 15, in which the means for adding the make-up liquid to the drawn-off liquid are connected to the means for sending the drawn-off liquid to the exchanger adjacent the pressurization means (25).

17. The plant according to claim 11, in which the means (1A, 1B, 1C) for sending the fluid to be separated to a column pass at least partially through the exchanger (9).

* * * * *